US005967954A

United States Patent [19]

Habing

[11] Patent Number: 5,967,954

[45] Date of Patent: Oct. 19, 1999

[54] CROSSOVER EXERCISER

[75] Inventor: Theodore J. Habing, Long Beach, Calif.

[73] Assignee: Precor Incorporated, Bothell, Wash.

[21] Appl. No.: 09/004,622

[22] Filed: Jan. 8, 1998

Related U.S. Application Data

[62] Division of application No. 08/748,550, Nov. 8, 1996, which is a continuation of application No. 08/508,630, Jul. 28, 1995, abandoned, which is a continuation of application No. 08/170,374, Dec. 20, 1993, Pat. No. 5,437,589.

[51] Int. Cl.[6] ..... A63B 23/12

[52] U.S. Cl. ..... 482/137; 482/100

[58] Field of Search ..... 482/56, 62, 72, 482/73, 94–98, 100, 133, 136–138

[56] References Cited

U.S. PATENT DOCUMENTS

| | | | |
|---|---|---|---|
| 126,796 | 5/1872 | Forward | 482/97 |
| 885,871 | 4/1908 | Scanlan | 482/72 |
| 2,183,345 | 12/1939 | Brandon | 482/72 |
| 4,494,751 | 1/1985 | Schell . | |
| 4,949,951 | 8/1990 | Deola . | |
| 4,986,538 | 1/1991 | Ish, III . | |
| 5,044,951 | 9/1991 | Jones . | |
| 5,120,289 | 6/1992 | Yu . | |
| 5,190,509 | 3/1993 | Davison | 482/100 |
| 5,211,614 | 5/1993 | Henes . | |
| 5,336,153 | 8/1994 | Chen . | |

FOREIGN PATENT DOCUMENTS

| | | |
|---|---|---|
| 1720666 | 3/1992 | U.S.S.R. . |
| 2223606 | 4/1990 | United Kingdom . |

OTHER PUBLICATIONS

Brochure: Galaxy Sport Pectoral Isolator Nr. 142.

Brochure: Vertical Pectoral Contractor and Rear Deltoid Machine (CH504), Body Masters Sports Industry, Inc.

*Primary Examiner*—John Mulcahy

*Attorney, Agent, or Firm*—Blakely, Sokoloff, Taylor & Zafman LLP

[57] ABSTRACT

An exercise machine has a frame, a seat and a pair of exercise arm assemblies. Each of the exercise arm assemblies is pivotally attached to the frame. Handles at the outer extremities of the arm assemblies are gripped by the user to perform the intended exercise. The geometry of the arms and their pivot points is arranged so that the handles of the assemblies follow arcuate paths which converge as the handles are moved forwardly. At a starting position for a press exercise, the handles are approximately in line with the shoulders of the user. As the handles are pushed forwardly against an exercise resistance, they converge inwardly until they are nearly touching when the user's arms are fully outstretched. The machine may also be used to perform a seated-row exercise, in which case the handles are pulled rearwardly against the exercise resistance.

20 Claims, 9 Drawing Sheets

70
42
72
10
32
26
35
34
33
64
14
54
23
90
30
31
29
22
79
98
100
27
92
12
28
21
77
96
24
94

42
16
41
10
66
32
64
43
68
40
35
26
34
36
55
18b
33
58
106a
56
54
74
90
110
52
62
23
76
18a
108a
25b
60
25a
21
77
50
22
86a

CROSSOVER EXERCISER

This is a divisional of application Ser. No. 08/748,550 filed Nov. 8, 1996, which is a continuation of application Ser. No. 08/508,630 filed Jul. 28, 1995, now abandoned, which is a continuation of application Ser. No. 08/170,374 filed Dec. 20, 1993, now U.S. Pat. No. 5,437,589.

BACKGROUND OF THE INVENTION

1. Related Applications

2. Field of the Invention

This invention relates generally to the field of resistance type exercise machines, and particularly to a machine for exercising the muscle groups of the upper torso and arms.

3. Background

A wide variety of exercise machines have been designed to develop particular muscle groups of the body. Most such machines have one or more operable members to be gripped by a user while performing exercises. The operable member is typically supported by the exercise machine so that it is constrained to follow a predetermined exercise path. The user is therefore constrained to move his or her body in accordance with the mechanical structure of the machine.

Machines of this sort provide a degree of exercise control that is in marked contrast to the use of free weights that are still favored by many athletes. Exercise movements with free weights are not restricted to follow predefined paths. On the other hand, exercise machines typically employ a pivoting exercise member with a grip that moves in an arcuate path centered at the pivot axis of the exercise member. Although this controlled movement of the exercise member is generally desirable in order to isolate the exercise to particular muscles or muscle groups, the mechanical design of prior art exercise machines does not necessarily provide an optimum path of movement.

One of the most common exercises performed with an exercise machine is a chest press exercise. The athlete is typically seated, often in a slightly reclining position. A press arm pivots on a horizontal axis and is gripped at approximately shoulder level. The press arm is coupled to a resistance mechanism, most commonly a stack of weights in which the number of weights, and thereby the resistance, can be manually selected. A pair of horizontal handgrips are provided, and quite often a pair of vertical handgrips are provided as well. The exercise is performed by pressing forward on the handgrips against the selected resistance until the athlete's arms are outstretched. When performed in this manner, the exercise emphasizes the pectorals and triceps. Changing the position of the handgrips will slightly alter the muscular emphasis of the exercise.

Variations on the traditional chest press exercise machine have been developed in order to shift the muscular emphasis of the exercise and/or improve the physiological interface. For example, U.S. Pat. No. 5,044,631 issued to Jones discloses a decline press exercise machine in which a pair of independently pivoting press arms are suspended on axes that converge in a horizontal plane. The press arms therefore move in arcuate paths that lie in vertical planes which converge inwardly with respect to the longitudinal centerline of the machine. Such an arrangement is claimed to more naturally accommodate musculoskeletal movements of the arms and shoulders.

U.S. Pat. No. 4,949,951 issued to Deola discloses an exercise device having a suspended U-shaped member resembling a conventional press arm, but with two bar members connected to the lower ends of the U-shaped member by universal joints. The freedom of movement afforded by the universal joints allows the device to be used for performing either a conventional chest press exercise or a dumbbell fly exercise.

A vertical pectoral contractor and rear deltoid machine manufactured by Body Masters Sports Industry, Inc. as model CH 504 provides a pair of exercise arms that pivot about vertical axes located approximately in line with the user's shoulder joints. To exercise the pectoral muscles, the user grasps handgrips suspended from the overhead exercise arms and rotates them forwardly and inwardly through symmetric circular arcs that are concave with respect to the user's torso.

A pectoral isolator manufactured by Galaxy Sport as model 142 also provides a pair of pivotal exercise arms. However, in this machine, the pivot axes are well forward and outboard of the seating position. The user begins the exercise with the handgrips out to each side and rotates the exercise arms forwardly and inwardly in circular arcs that are convex to the user's torso.

SUMMARY OF THE INVENTION

One of the objects of the present invention is to provide a machine for performing an improved chest press exercise.

Another object of the present invention is to provide a chest press exercise machine that places greater emphasis on development of the pectoral muscles.

A further object of the present invention is to provide a chest press exercise machine in which the user need not support the exercise arms against the force of gravity.

Yet another object of the present invention is to provide a converging motion chest press exercise machine in which the resistance increases throughout the forward exercise motion.

Still another object of this invention is to provide an apparatus for performing a seated row exercise in which the path of the exercise motion arcs outwardly as the user pulls back against the exercise resistance.

These and other objects of the present invention are accomplished in an exercise machine that has a frame, a seat and a pair of articulated exercise arm assemblies. Each of the exercise arm assemblies is pivotally attached to the frame in an arrangement that is sometimes referred to as a four bar linkage. The outer extremities of the articulated arm assemblies are gripped by the user to perform the intended exercise. The geometry of the arms and their pivot points is arranged so that the handgrips of the articulated assemblies follow non-circular arcuate paths which converge as the handgrips are moved forwardly. At a starting position for a press exercise, the handgrips are approximately in line with the shoulders of the user and to either side. As the handgrips are pushed forwardly against the exercise resistance, they converge inwardly until they are nearly touching when the user's arms are fully outstretched.

The articulated arm assemblies are constrained to move within a plane that is slightly inclined from the horizontal. Therefore, in performing the exercise, the user need not support the weight of the exercise arms as would be the case when using a device such as shown in the aforementioned U.S. Pat. No. 4,949,951. Resistance is provided by conventional means, such as a weight stack. Resistance is preferably coupled to the articulated arm assemblies through a system of cables and pulleys so that the effective resistance for press exercises increases throughout the forward movement of the handgrips. For performing a seated-row exercise, the resistance is coupled to the articulated arm assemblies so that rearward movement of the handgrips is resisted. In this case, the starting and ending positions of the exercise are reversed from those of the press exercise.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

Figure 1:
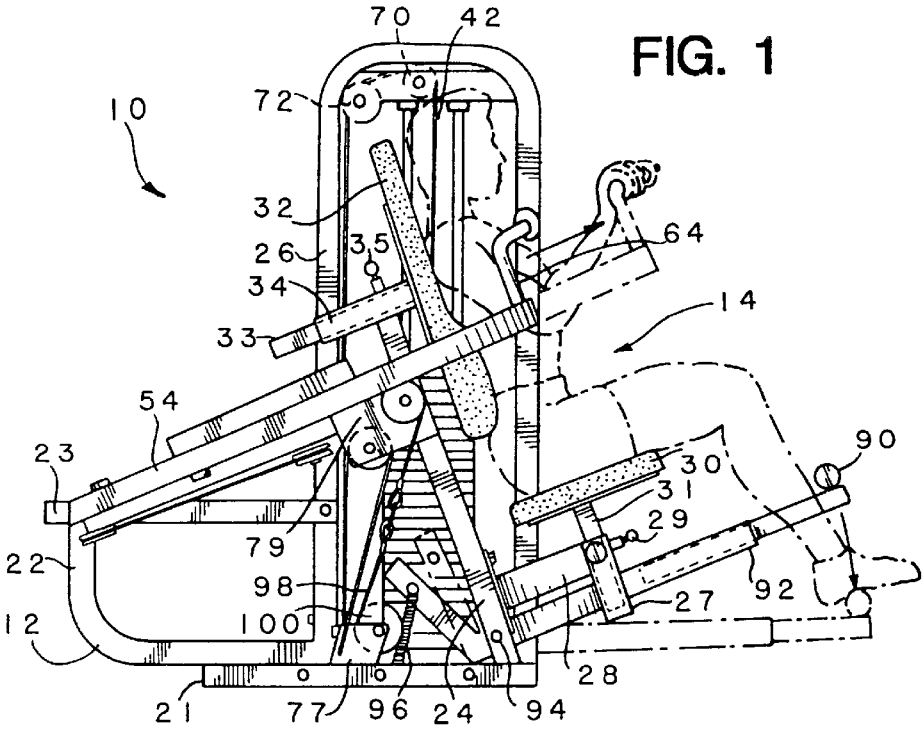
FIG. 1 is an elevation view of an exercise machine embodying the present invention.
Figure 2:
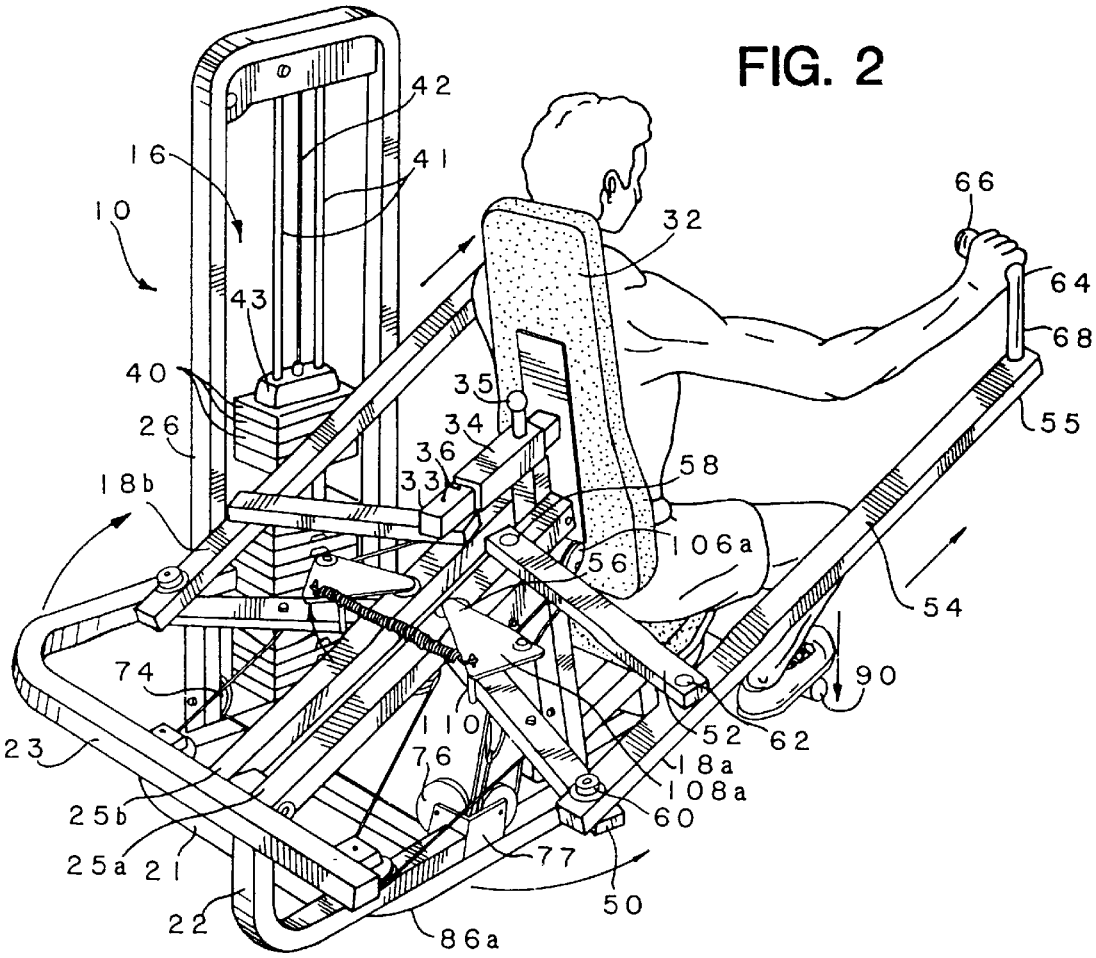
FIG. 2 is a perspective view of the exercise machine of FIG. 1.

FIGS. 1 and 2 show an exercise machine 10 constructed in accordance with the present invention. In terms of major components, machine 10 comprises a frame 12, a seat 14, a weight stack assembly 16 and a pair of articulated arm assemblies 18*a* and 18*b*. Frame 12 is constructed in a conventional manner from square and/or rectangular section steel tubing. Individual frame members are joined together by welding, mechanical fasteners or other appropriate means. Frame 12 comprises a generally U-shaped base member 21 which rests on the floor or other supporting surface. A generally L-shaped member 22 is secured to base member 21 and supports another generally L-shaped member 23 which extends across the rear of apparatus 10. An inclined upright frame member 24 extends upwardly from the forward end of base member 21. A pair of inclined longitudinal frame members 25*a, b* extend between the intersection of frame members 22 and 23 and the upper portion of upright 24. An inverted U-shaped member 26 encloses weight stack assembly 16 and is secured to one leg of base member 21 and also to frame member 23.

Seat 14 comprises a seat cushion 30 and a back support cushion 32, although seat 14 could also be of unitary construction. Seat cushion 30 is mounted on support post 31 which telescopes within tubular member 27. Member 27 is secured to frame extension member 28 which, in turn, is secured to upright frame member 24. The vertical position of seat cushion 30 is adjusted by inserting spring-loaded pop-pin 29 into a selected one of a plurality of holes in support post 31 in accordance with conventional design practices for exercise equipment.

In similar fashion, back support cushion 32 is mounted on support post 33 which telescopes within tubular member 34. Member 34 is secured to the top of upright member 24. The longitudinal position of back support cushion 32 is adjusted by inserting pop-pin 35 into a selected one of a plurality of holes 36 in support post 33. Although not illustrated in this embodiment, it may be desirable to secure back cushion 32 to support post 33 in such a manner so that the angle of inclination is also adjustable.

In the illustrated embodiment, weight stack assembly 16 is of entirely conventional construction. A plurality of weight plates 40 are provided, each having a uniform predetermined weight, most typically 10 pounds. Weight plates 40 move vertically on guide bars 41 within supporting frame member 26. A top weight 43 is coupled to cable 42. A central rod (not visible) extends down from top weight 43 through each of weight plates 40. A pin (also not visible) is inserted into the central rod between the weight plates to select the desired amount of weight to be used for the exercise routine. Although this embodiment of the invention is described with weight stack assembly 16 providing the exercise resistance, it will be recognized that the invention may be practiced with other means for supplying resistance. Various other mechanical, electromechanical, pneumatic, and hydraulic means for providing resistance are well known to those skilled in the art of exercise equipment.

Articulated arm assemblies 18*a* and 18*b* are symmetric in construction. Assembly 18*a* will be described in detail, however, it will be understood that the details of assembly 18*b* are symmetrically identical. Assembly 18*a* comprises a rear transverse arm 50, a forward transverse arm 52 and an outboard arm 54. Arm 50 is pivotally coupled to longitudinal frame member 25*a* with pivot assembly 56. Likewise, arm 52 is pivotally coupled to longitudinal frame member 25*a* with pivot assembly 58. Outboard arm 54 is pivotally coupled to transverse arms 50 and 52 with pivot assemblies 60 and 62, respectively. Pivot assemblies 56, 58, 60 and 62 may employ ball bearings, bronze bushings or other suitable pivotal couplings.

A handgrip 64 is coupled to the forward end 55 of outboard arm 54. Handgrip 64 is generally L-shaped so that it may be grasped at either horizontal portion 66 or vertical portion 68 as desired by the user. Handgrip 64 is preferably covered with a foam or similarly resilient material to provide a comfortable gripping surface.

The resistance selected on weight stack assembly 16 is communicated to the articulated arm assemblies 18*a* and 18*b* in the following manner. Cable 42, which is attached to top weight 43, passes around pulleys 70 and 72 and extends downwardly alongside supporting frame member 26. Cable 42 continues around lower pulley 74 and then runs transversely to pulley 76 which is mounted to bracket 77 on frame base member 21. At this point, it is helpful to refer also to FIGS. 5 and 6 to follow the remainder of the resistance communication path. From pulley 76, cable 42 runs upwardly to pulley 78 mounted on bracket 79 attached to upright member 24 immediately below longitudinal frame members 25*a, b.* Pulley 78 is generally aligned with the longitudinal center line of apparatus 10. Cable 42 continues rearwardly over pulley 78 and is secured to block 80 of floating pulley 82. A second cable 84 is reeved around floating pulley 82 and also around fixed pulleys 86*a* and 86*b* which are rotatably mounted on frame member 23. Each end of cable 84 is secured to respective transverse arm members 50 with a bolt or other suitable attachment means 88.

Figure 5:
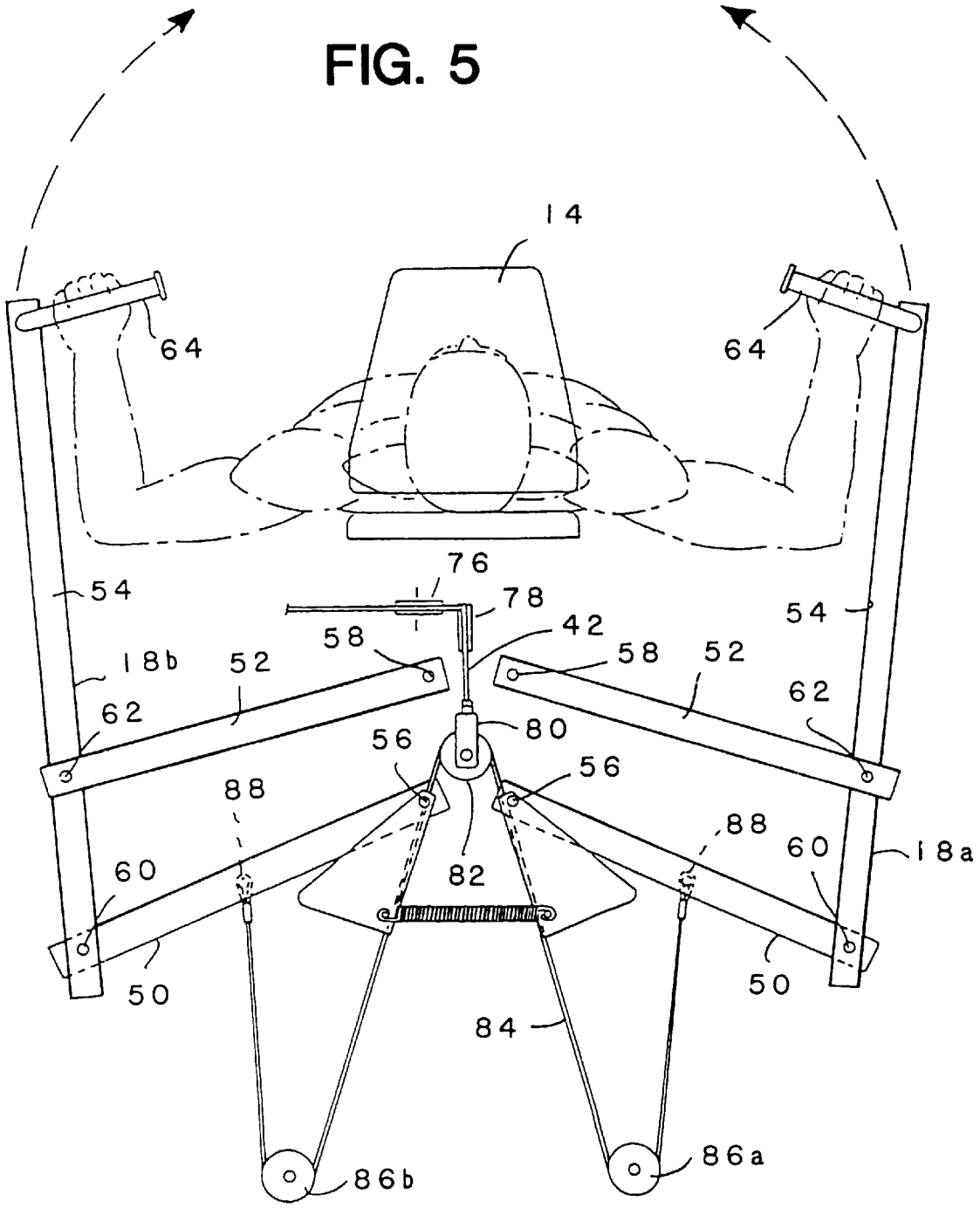
FIG. 5 is a diagrammatic view of the exercise machine of FIG. 1 showing the exercise arms near a starting position for performing a press exercise.
Figure 8:
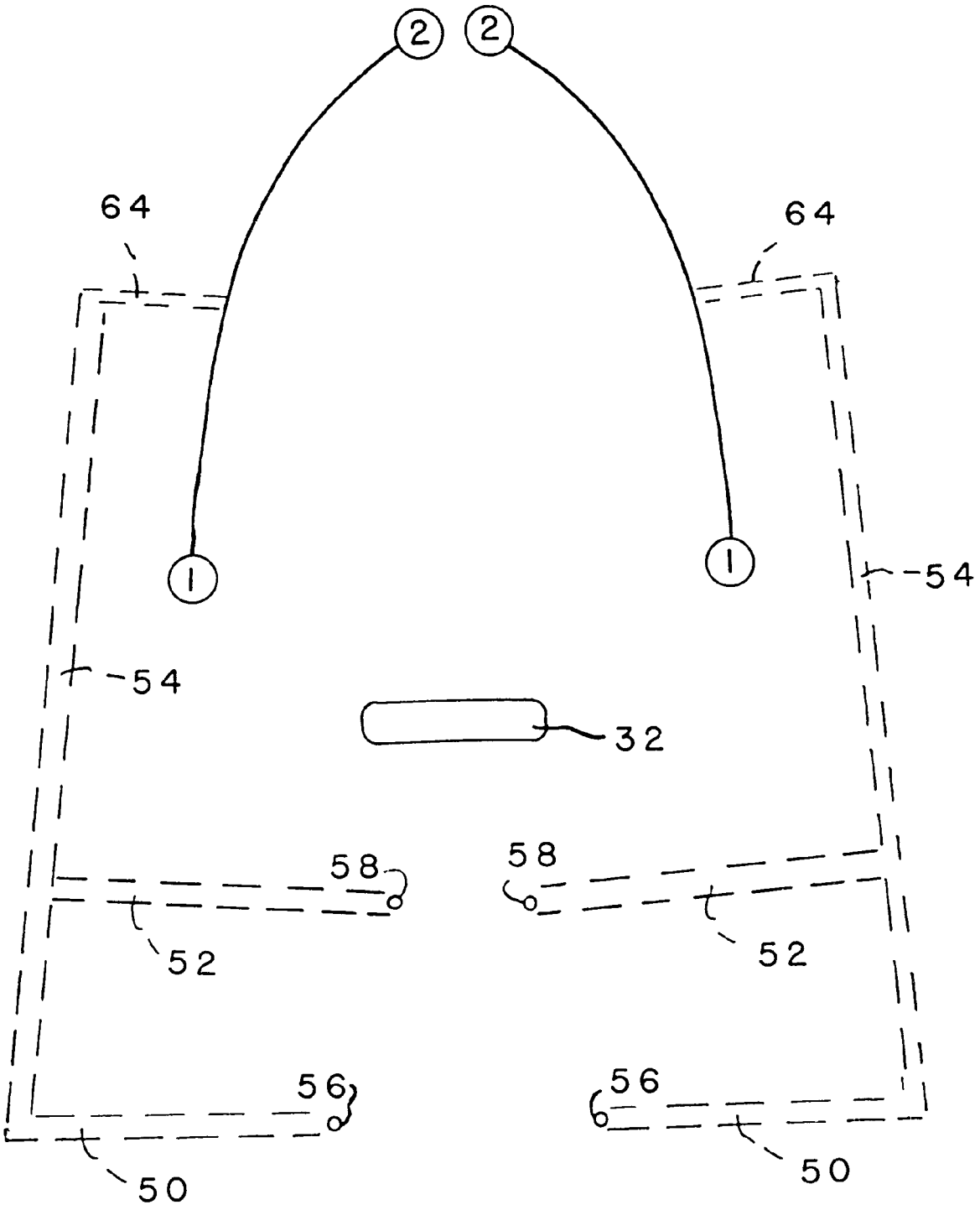
FIG. 8 illustrates the arcuate paths of motion for the exercise handgrips of the exercise machine of FIG. 1.

FIG. 5 illustrates apparatus 10 with the arm assemblies moved just beyond the starting position of a press exercise. Cable 42 is retracted by weight stack assembly 16 so that floating pulley 82 is located forward near fixed pulley 78. Cable 84 draws back on transverse arms 50. In the absence of any force exerted by the user, the articulated arm assemblies would be fully retracted with the ends of outboard arms 54 resting against frame member 23. In the position illustrated in FIG. 5, it will be noted that handgrips 64 are generally in line with the shoulders of a user seated in seat 14. The user grasps handgrips 64 and pushes forwardly, thereby drawing back on floating pulley 82 and lifting the selected number of weight plates 40. The exercise continues through the position illustrated in FIG. 6 until the user's arms are fully extended. At the end of the exercise stroke, handgrips 64 have converged inwardly until they are nearly touching, having followed arcuate paths indicated by the dashed lines in FIG. 5. The exact shape of these paths is determined by the interplay of many factors, including the relative placement of arm pivots 56, 58, 60 and 62, the lengths of the transverse arms 50 and 52 and the lengths of arms 54. FIG. 8 illustrates the paths followed by the handgrips in an exemplary embodiment of the invention. Unlike certain prior art machines, the arcuate paths of the handgrips are not centered on an axis that passes through any of the user's body joints. Partly as a result of this, the user's operation of the exercise arms through the exercise stroke involves a combination of bending movements of both the shoulder joints and elbow joints.

The only resistance that the user must overcome when performing an exercise is aligned with the direction of movement of the handgrips. Since the handgrips are constrained to remain in a plane by the articulated arm assemblies, there is no significant gravitational force acting on the arm assemblies that must be overcome during performance of the exercise as would be the case with free weights or with prior art exercise machines with universally jointed arms. As best seen in FIG. 1, the plane of movement is inclined with respect to the horizontal inasmuch as pivots 58 are at a higher elevation than pivots 56. As a result, there is a small gravitational component acting on arm assemblies 18*a, b* which is in line with the exercise resistance. To completely eliminate this gravitational component so that the amount of exercise resistance is determined solely by the selection of weight in weight stack 16, counterbalances may be incorporated in apparatus 10. These may be in the form of auxiliary weights or springs that are coupled to arm assemblies 18*a, b.*

As described above, the plane of movement of articulated arm assemblies 18*a, b* is inclined forwardly. Apparatus 10 may be constructed with any desired angle of inclination relative to seat 14 to provide a desired type of press exercise. Providing a tilt angle adjustment for back cushion 32 as already mentioned allows the user to easily adjust the relative angle of inclination, although such an adjustment necessarily has a somewhat limited range. As illustrated, apparatus 10 is configured to provide a traditional bench or chest press exercise. With appropriate modifications, a larger angle of inclination of the plane of movement relative to seat 14 would provide shoulder press or incline press exercises, whereas a smaller angle would provide a decline press exercise.

Figure 6:
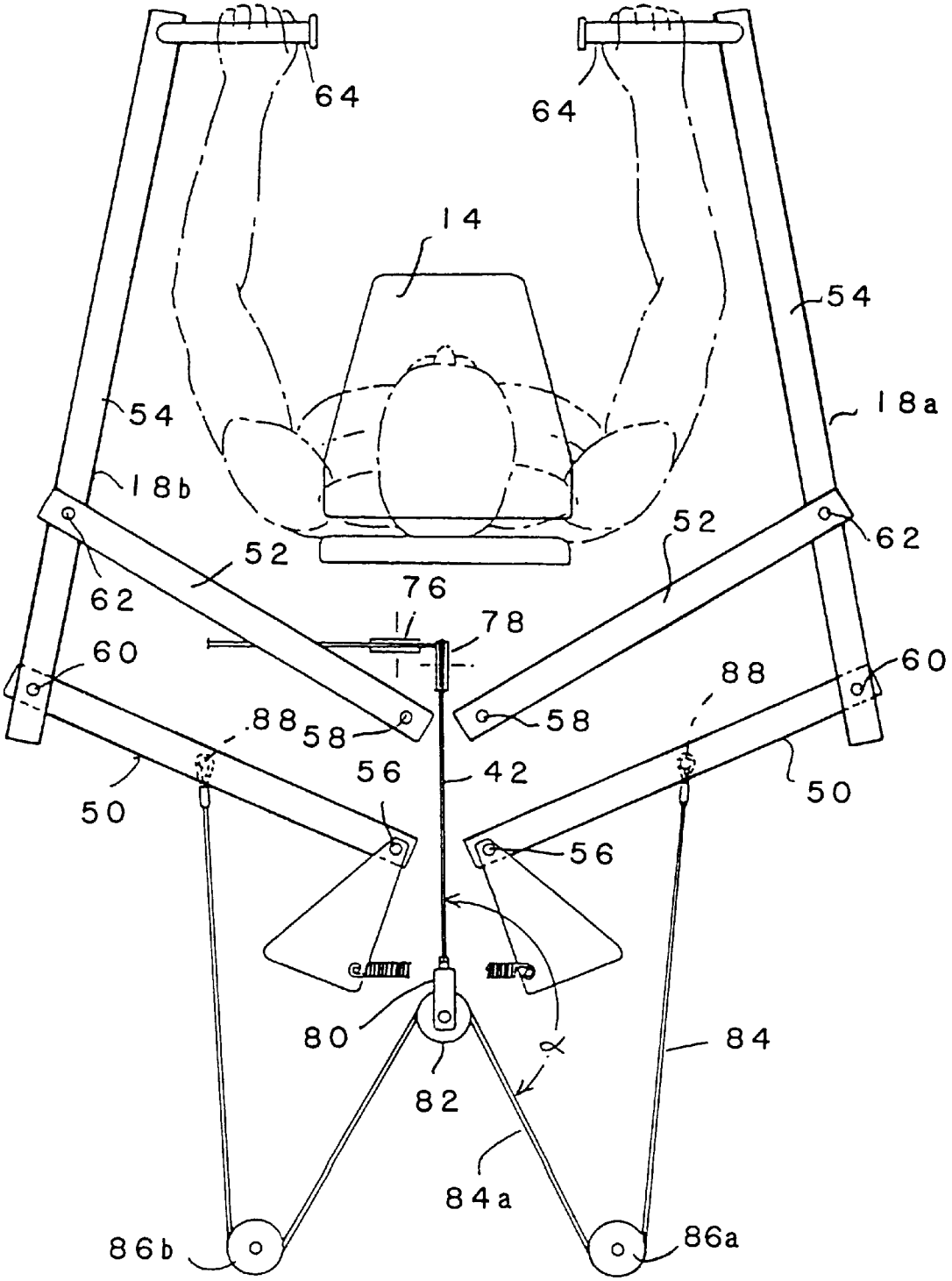
FIG. 6 is a diagrammatic view of the exercise machine of FIG. 1 showing the exercise arms at a partly extended position.
Figure 7A:
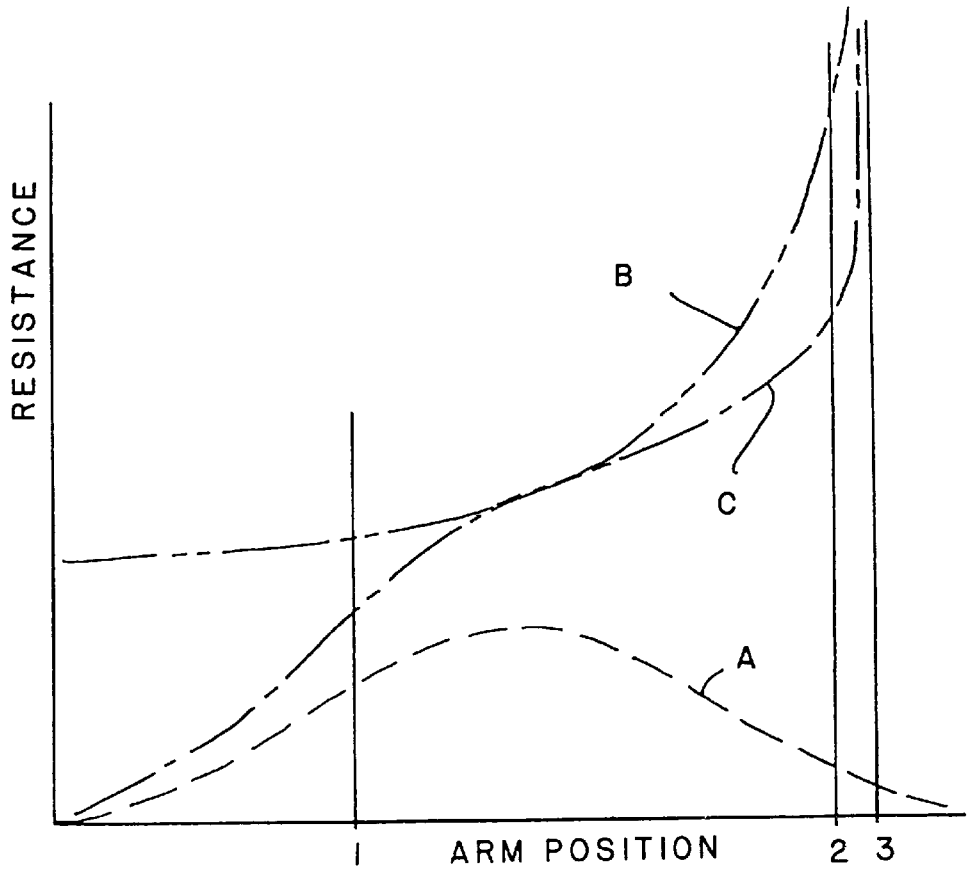
FIG. 7*a* and 7*b* diagrammatically illustrate the resistance curve experienced during performance of an exercise using the machine of FIG. 1.
Figure 7B:
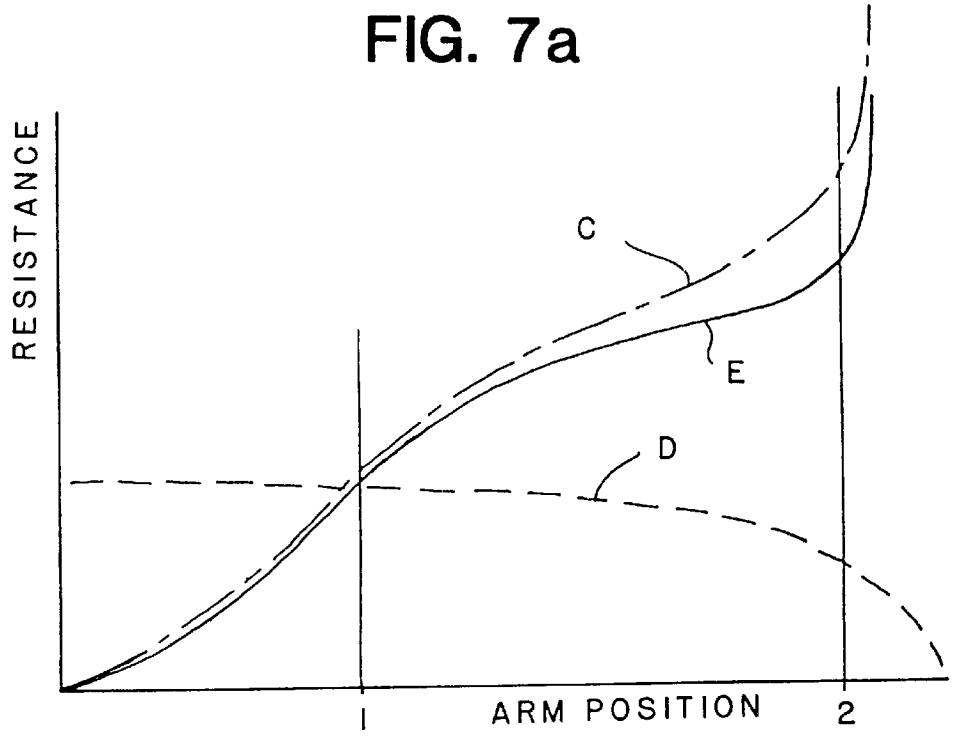

FIGS. 7*a* and 7*b* are plots showing the amount of exercise resistance encountered as a function of the travel of articulated arm assemblies 18*a,* 18*b* between the starting position 1 (approximately the position shown in FIG. 5) and the ending position 2 when the arm assemblies are at their forward limit of travel (beyond the position shown in FIG. 6). The total resistance encountered is the combination of several components. The first component, indicated by curve A, is a generally sinusoidal curve that results from the arcuate path of the cable attachment points 88. The second component, indicated by curve B, is a generally parabolic curve that results from the interaction of cable 84 and floating pulley 82. Referring for a moment to FIG. 6, it will be noted that, as the exercise arms are moved forwardly, cable 84 pulls rearwardly on floating pulley 82. The amount of resistance communicated from weight stack 16 to cable 84 varies as a function of the angle a between cable 42 and the portion 84*a* of cable 84 that is tangential to pulley 82. As pulley 82 is pulled further back, this angle decreases and the effective resistance communicated to cable 84 increases. When the arm assemblies are extended fully forward, floating pulley 82 approaches a position 3 (referring again to FIG. 7*a*) where it would be laterally aligned with fixed pulleys 86*a,* 86*b.* At this point, the resistance is effectively infinite since cable 84 would be pulling at right angles to cable 42 (i.e., $\alpha$=90°). The product of components A and B, indicated by curve C, is the total resistance acting in the longitudinal direction. It will be apparent that this resistance profile can be altered by adjusting the relative position of pulley 82 with respect to fixed pulleys 86*a,* 86*b* at any particular position of the exercise arms. Thus, for example, if cable 42 was shorter and cable 84 was longer, curve B would be shifted to the right in FIG. 7*a* and the increase in effective resistance at position 2 would be less pronounced.

The effective resistance experienced by the user is affected by the inward motion of handles 64. The leverage thus afforded, particularly toward the end of the press exercise stroke, reduces the effective resistance. This component is indicated by curve D. The net effective resistance experienced by the user at the handles 64, which is the product of curves C and D, is indicated by curve E. It will be observed that the resistance experienced by the user continually increases throughout the range of movement of arm assemblies 18*a,* 18*b* between positions 1 and 2.

The articulated arm assemblies 18*a, b* are independently pivoted on frame 12. That is, the movement of one of the arm assemblies does not cause a corresponding movement of the other arm assembly. Thus, the user can exercise the left and right sides independently. When doing so, the handgrip on the side being exercised can be moved beyond the longitudinal center line of apparatus 10, thereby providing a greater range of motion than is available when both arm assemblies are operated in unison.

Since it is desirable to have the range of movement of the handgrips 64 extend somewhat behind the user's shoulders, commencement of a press exercise may be difficult since the user must reach behind to grasp the handgrips. To alleviate this difficulty, apparatus 10 includes a mechanism to conveniently pre-position the articulated arm assemblies for commencement of an exercise routine. This mechanism is diagrammatically illustrated in FIGS. 3 and 4, which should be referred to in addition to FIGS. 1 and 2 for the following discussion.

Figure 3:
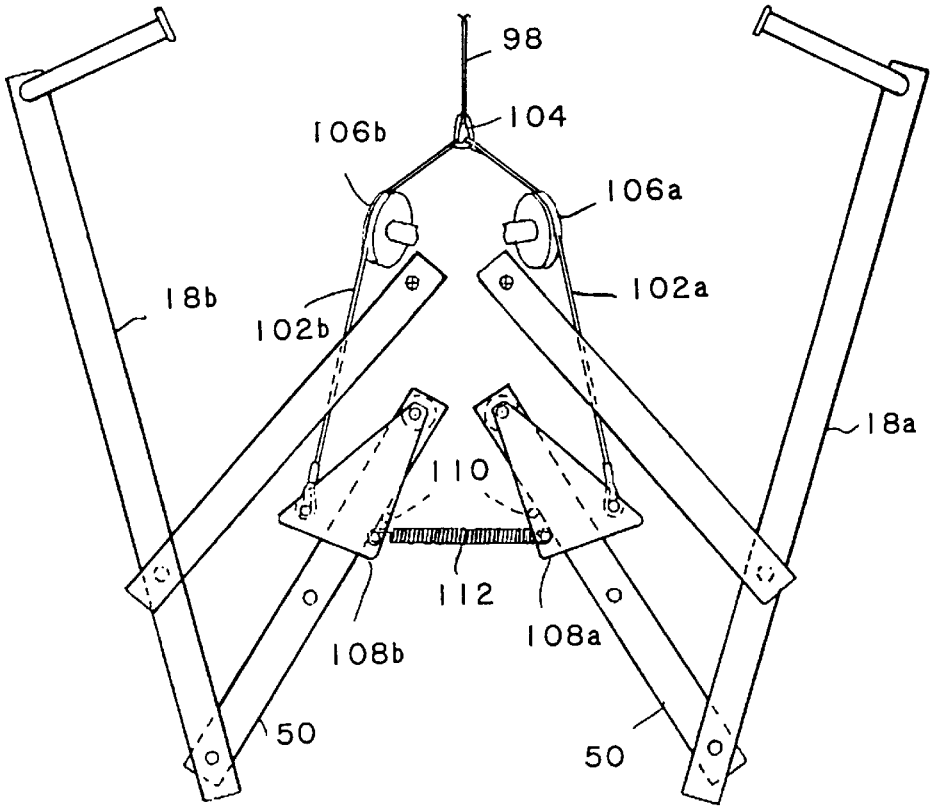
FIG. 3 is a diagrammatic view of the exercise machine of FIG. 1 showing the exercise arms in a rest position.
Figure 4:
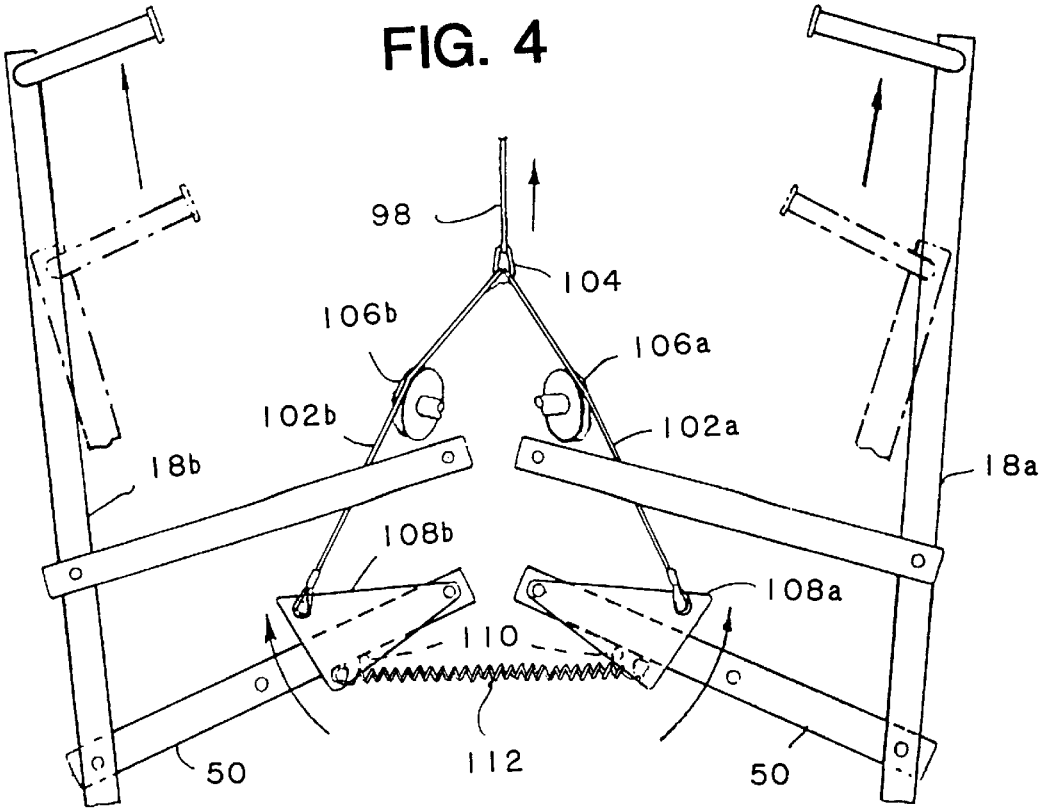
FIG. 4 is a diagrammatic view of the exercise machine of FIG. 1 showing the exercise arms being pre-positioned for performing a press exercise.

As explained above, weight stack 16, operating through the cable and pulley system comprising cables 42 and 84, retracts the articulated arm assemblies to the rest position shown in FIG. 3. To bring the arm assemblies forward to the exercise starting position shown in FIG. 4 (the same position as shown in FIG. 5), the user, while seated, steps down on cross bar 90 of lever 92. Lever 92 is pivotally coupled to upright member 24 at pivot 94 and is biased to the position shown in solid lines in FIG. 1 by spring 96. Cable 98 is secured to lever 92 and is trained around pulley 100 which is rotatably mounted to bracket 77. Cable 98 is coupled to cables 102*a, b* at ring 104. Each of cables 102*a, b* is trained over a respective pulley 106*a, b* rotatably mounted to bracket 79 and is secured to a respective cam plate 108*a, b*. The cam plates are pivotally mounted to the respective longitudinal frame members 25*a, b* at pivots 56. A peg 110 is attached to each of cam plates 108*a, b* and bears against the respective transverse arm 50. As lever 92 is pressed downwardly (indicated by phantom lines in FIG. 1), cam plates 108*a, b* are rotated forwardly as indicated by the arrows in FIG. 4, thereby bringing forward the articulated arm assemblies 18*a, b*. Once articulated arm assemblies 18*a, b* have been brought forward to the starting position and handgrips 64 have been grasped by the user, lever 92 may be released and the user may proceed with the exercise routine with his feet resting on the floor. Cam plates 108*a, b* are returned to their rest positions by spring 112 following actuation and release of lever 92.

Figure 9:
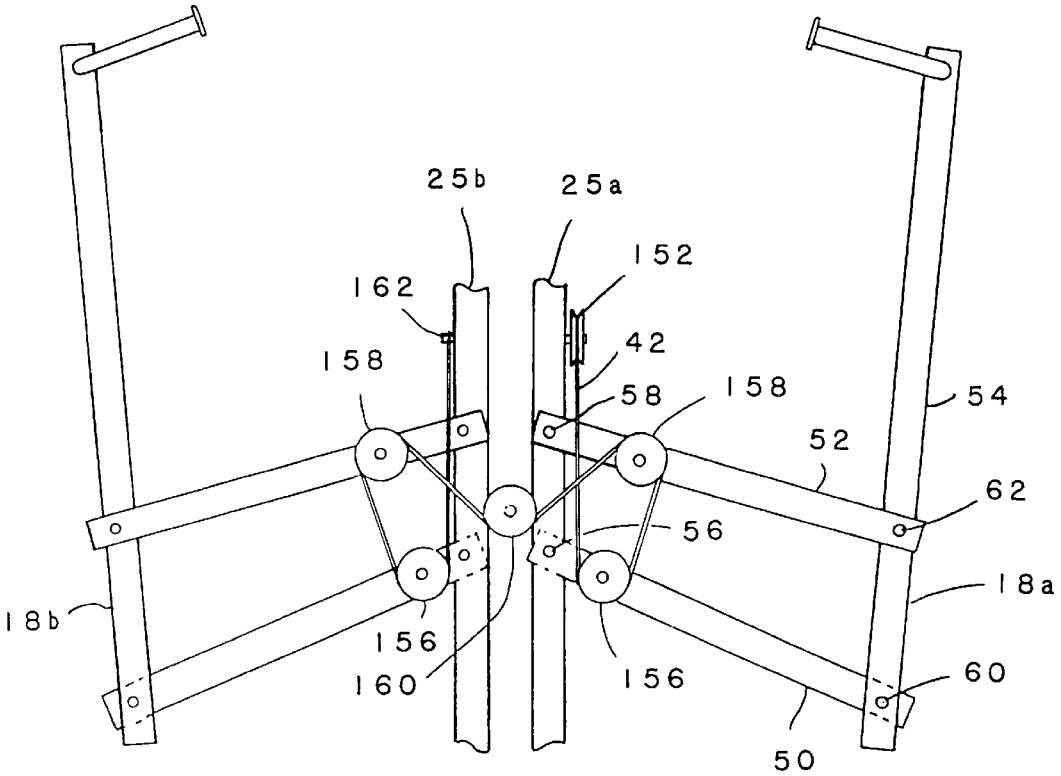
FIG. 9 is a diagrammatic view of a modified version of the exercise machine of FIG. 1.

FIG. 9 illustrates a modification of exercise machine 10 described above. In this modification, floating pulley 82 and secondary cable 84 are removed. Cable 42, one end of which is attached to the weight stack, is guided over pulley 152, which is rotatably mounted on longitudinal frame member 25*a*. Cable 42 is guided rearwardly to pulley 156, which is rotatably mounted on transverse arm 50, adjacent to and slightly outboard of pivot point 56. Cable 42 is then guided forwardly around pulley 158, which is rotatably mounted on transverse arm 52 adjacent to and slightly outboard of pivot point 58. Cable 42 continues around pulley 160, which is rotatably mounted between longitudinal frame members 25*a* and 25*b*, and thence around pulleys 158 and 156 of left side arm assembly 18*b*. Cable 42 is then secured to longitudinal frame member 25*b* by a bolt or similar suitable means at point 162. Forward movement of arm assemblies 18*a*, 18*b* lengthens the path of cable 42, thereby raising the selected weight plates of the weight stack.

The resistance curve for the modified machine of FIG. 9 is essentially the same as curve A of FIG. 7*a*. This resistance curve has a generally sinusoidal shape such that decreasing resistance is encountered past a mid point of the exercise stroke. Although continually increasing resistance is generally preferred for muscle conditioning, there may be situations where a sinusoidal resistance profile is desired.

Figure 10:
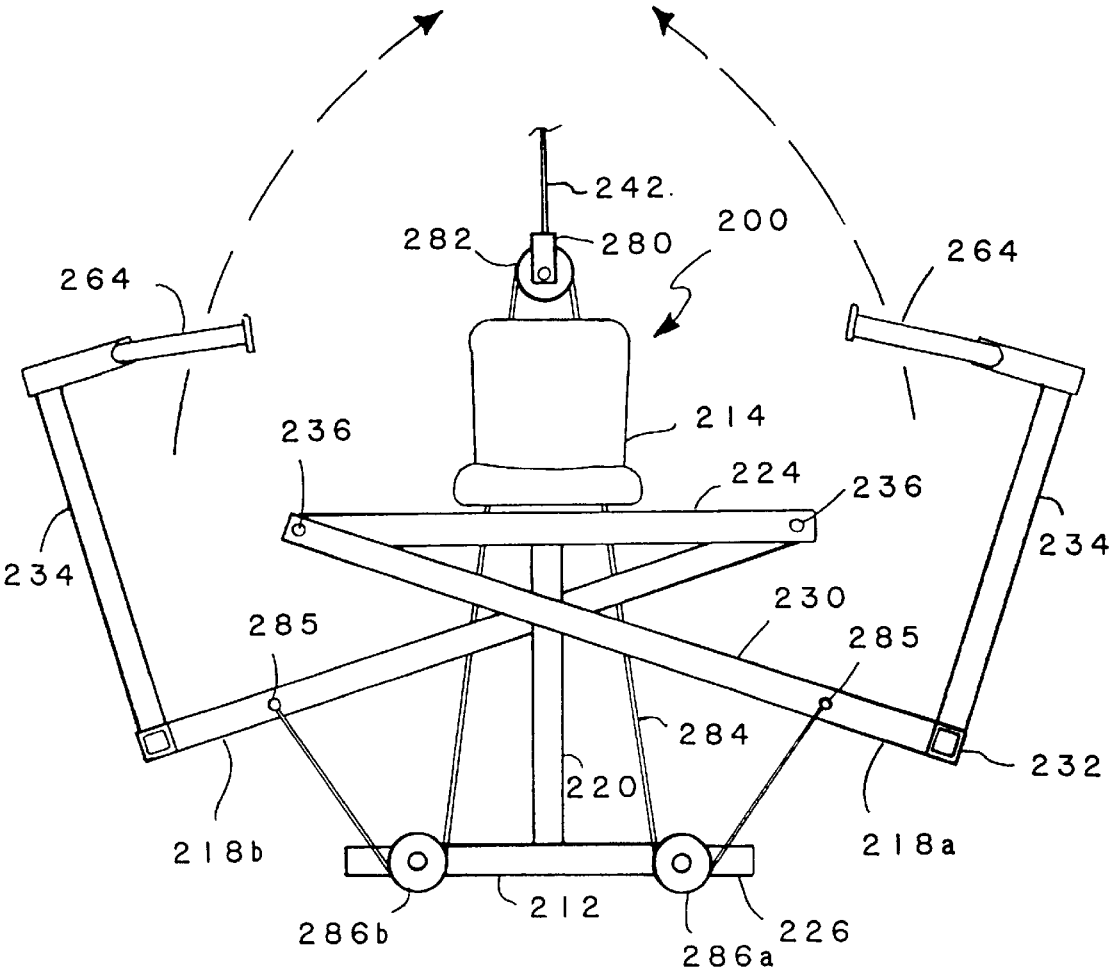
FIG. 10 is a diagrammatic view of an alternative embodiment of the present invention.

FIG. 10 illustrates an alternative embodiment of the present invention, which is generally similar to apparatus 10 described above, but which utilizes an alternative pivoting arrangement for the exercise arms. Exercise machine 200 comprises a frame 212, a seat 214 and a pair of pivoting arm assemblies 218*a* and 218*b*. Exercise machine 200 also includes a weight stack (not shown) or other means for providing exercise resistance. Seat 214 and the weight stack assembly may be identical to the corresponding components described above in connection with exercise machine 10. Frame 212 comprises a longitudinal member 220 and lateral members 224 and 226.

As in the previously described embodiment, arm assemblies 218*a* and 218*b* are symmetric in construction. Assembly 218*a* will be described in detail, however, it will be understood that the details of assembly 218*b* are symmetrically identical. Assembly 218*a* comprises a transverse arm 230, a vertical arm member 232 and an outboard arm 234. As with the previously described embodiment, a handgrip 264 is coupled to the forward end of each of the outboard arms 234. Transverse arm 230 is pivotally coupled to transverse frame member 224 at pivot point 236. In contrast to the previously described embodiment, each of arm assemblies 218*a*, 218*b* has but a single pivot point.

Arm assemblies 218*a*, 218*b* are coupled to the weight stack in a manner substantially similar to that of exercise machine 10 shown in FIGS. 1–6. A cable 284 is attached at opposite ends thereof to each of transverse arms 230 at attachment points 285. Cable 284 is guided around fixed pulleys 286*a*, 286*b*, which are rotatably attached to transverse frame member 226, and around floating pulley 282. Cable 242 is coupled between the weight stack and block 280, which rotatably supports floating pulley 282.

It will be observed that the path followed by handgrips 264 in this embodiment of the invention are symmetrical circular arcs centered at pivot points 236. These arcs are concave to the user's torso and lie in a plane slightly inclined from the horizontal and perpendicular to the axes of pivots 236. The rotational axes in this device are not aligned with the user's shoulder joints. Indeed, the pivot axis for each handgrip is well removed from the corresponding shoulder joint due to the cross-over of the exercise arms 230.

Figure 11:
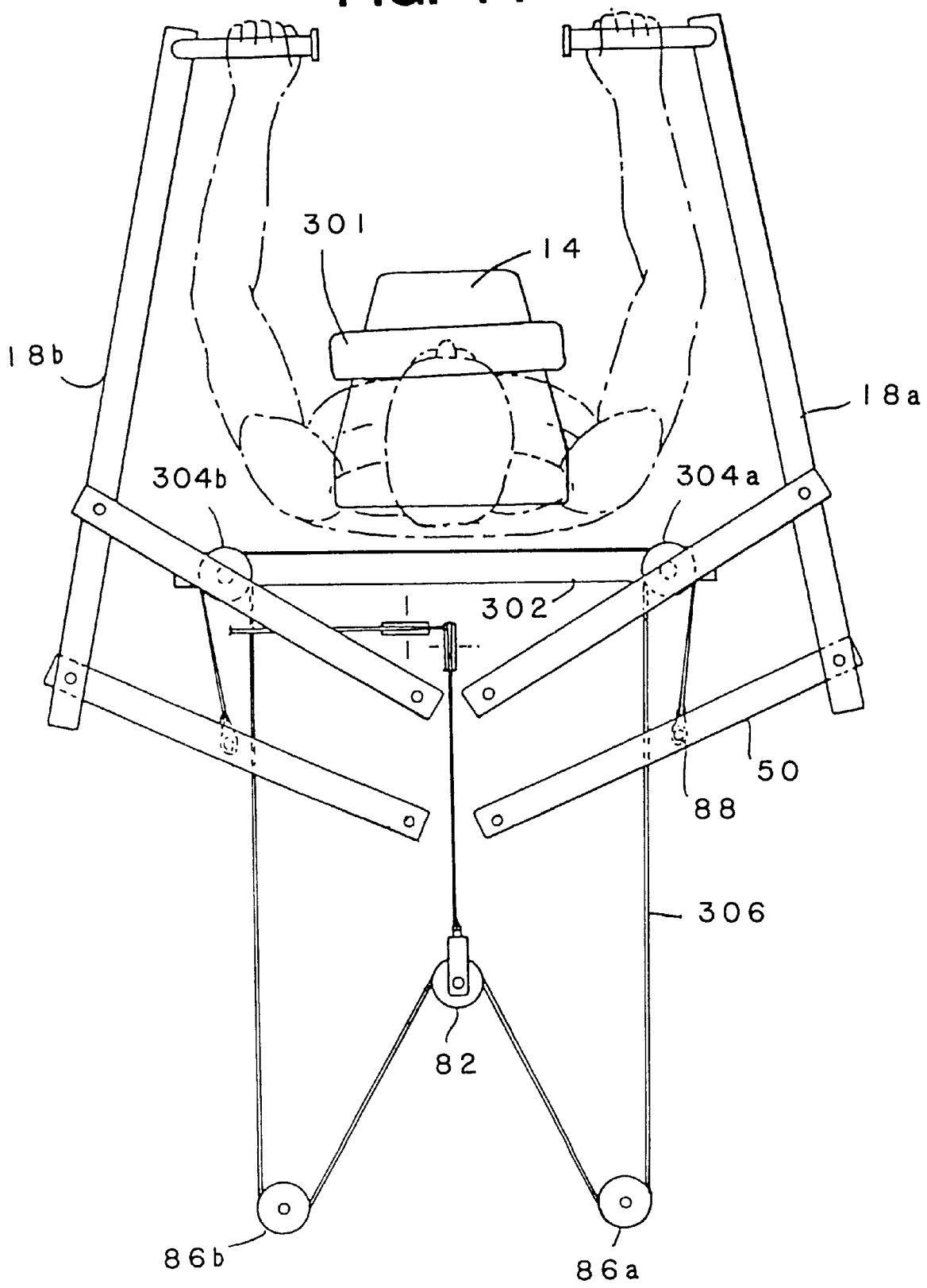
FIG. 11 is a diagrammatic view of a further alternative embodiment of the present invention adapted for use as a seated-row exerciser.

FIG. 11 illustrates a modification of apparatus 10 for use in performing a seated-row exercise. In this modification, the user pulls rearwardly against the exercise resistance, in contrast to the press exercise in which the user pushes forwardly against the resistance. The starting position for the seated-row exercise thus generally corresponds to the ending position of the press exercise and, likewise, the ending position for the seated-row exercise generally corresponds to the starting position of the press exercise. A cushion 301 is provided in front of the user's chest for support during performance of the seated-row exercise. A transverse frame member 302 is added behind seat 14 to support a pair of pulleys 304*a, b*. Cable 306 takes the place of cable 84 used in apparatus 10 for performing press exercises. Cable 306 is guided around floating pulley 82 and fixed pulleys 86*a, b* in the same manner as cable 84, but is also guided around pulleys 304*a, b* before being attached to transverse arms 50 at attachment points 88. The direction of force exerted by weight stack 16 is thus reversed relative to the unmodified apparatus 10 so that exercise resistance is encountered when pulling back on arm assemblies 18*a, b*.

It will be recognized that the above described invention may be embodied in other specific forms without departing from the spirit or essential characteristics of the disclosure. Thus it is understood that the invention is not to be limited by the foregoing illustrative details.

What is claimed is:

1. An exercise machine comprising:

a frame defining a longitudinal center line of the machine with an operator's position thereon;

a left exercise unit having a contact portion for exercising a left extremity of an operator of the exercise machine, said left exercise unit pivotally coupled to the frame of the exercise machine at a first pivot location to the right of the longitudinal center line of the machine;

a right exercise unit having a contact portion for exercising a right extremity of an operator, said right exercise unit pivotally coupled to the frame of the exercise machine at a second pivot location to the left of the longitudinal center line; and means for resisting movement of the left and right exercise units;

wherein the contact portions of the left and right exercise units have symmetric arcuate paths of travel to the left and right, respectively, of the longitudinal center line concave with respect to the operator's position throughout the path of travel.

2. The exercise machine of claim 1 wherein the contact portions of the left and right exercise units comprise handgrips.

3. The exercise machine of claim 1 wherein the means for resisting movement of the exercise units comprises a weight.

4. The exercise machine of claim 3 wherein the means for resisting movement of the exercise units further comprises a cable and pulley system connecting the exercise units to the weight.

5. The exercise machine of claim 1 wherein the means for resisting movement of the exercise units comprises a selectable weight stack.

6. An upper body exercise machine comprising:

a frame;

a support having a fixed position on the frame during use of the exercise machine for supporting an operator of the exercise machine, said support defining a longitudinal center line of the exercise machine and further defining forward and rearward directions;

a left exercise unit for exercising an operator's left arm, said left exercise unit pivotally coupled to the frame of the exercise machine at a first pivot location to the right of the longitudinal center line, said left exercise unit extending from the first pivot location outwardly to the left of the longitudinal center line and forwardly and terminating at a left handgrip;

a right exercise unit for exercising an operator's right arm, said right exercise unit pivotally coupled to the frame of the exercise machine at a second pivot location to the left of the longitudinal center line, said first and second pivot locations being symmetrically disposed with respect to the longitudinal center line, said right exercise unit extending from the second pivot location outwardly to the right of the longitudinal center line and forwardly and terminating at a right handgrip; and means for resisting movement of the left and right exercise units.

7. The exercise machine of claim 6 wherein the support comprises a seat cushion.

8. The exercise machine of claim 7 wherein the support further comprises a back support cushion.

9. The exercise machine of claim 6 wherein the first pivot location is disposed rearward of the support.

10. The exercise machine of claim 6 wherein the second pivot location is disposed rearward of the support.

11. The exercise machine of claim 6 wherein the means for resisting movement of the exercise unit comprises a weight.

12. The exercise machine of claim 11 wherein the means for resisting movement of the exercise units further comprises a cable and pulley system connecting the exercise units to the weight.

13. The exercise machine of claim 6 wherein the means for resisting movement of the exercise units comprises a selectable weight stack.

14. An exercise machine comprising:

a frame;

a support having a fixed position on the frame during use of the exercise machine for supporting an operator of the exercise machine;

a left exercise unit having a contact portion for exercising a left extremity of an operator, said left exercise unit pivotally coupled to the frame of the exercise machine at a first pivot location to the right of a longitudinal center line of the machine, said contact portion being disposed to the left of the longitudinal centerline;

a right exercise unit having a contact portion for exercising a right extremity of an operator, said right exercise unit pivotally coupled to the frame of the exercise machine at a second pivot location to the left of a longitudinal center line, said contact portion being disposed to the right of the longitudinal center line, said first and second pivot locations being symmetrically disposed with respect to the longitudinal center line; and means for resisting movement of the left and right exercise units;

wherein the contact portions of the left and right exercise units have symmetric arcuate paths of travel to the left and right, respectively, of the longitudinal center line concave with respect to the support throughout the path of travel.

15. The exercise machine of claim 14 wherein the support comprises a seat cushion.

16. The exercise machine of claim 15 wherein the support further comprises a back support cushion.

17. The exercise machine of claim 14 wherein the first pivot location is disposed rearward of the support.

18. The exercise machine of claim 14 wherein the second pivot location is disposed rearward of the support.

19. The exercise machine of claim 14 wherein the means for resisting movement of the exercise units comprises a weight.

20. The exercise machine of claim 19 wherein the means for resisting movement of the exercise units further comprises a cable and pulley system connecting the exercise units to the weight.

* * * * *

UNITED STATES PATENT AND TRADEMARK OFFICE

CERTIFICATE OF CORRECTION

PATENT NO. : 5,967,954

DATED : October 19, 1999

INVENTOR(S) : Habing

It is certified that error appears in the above-identified patent and that said Letters Patent is hereby corrected as shown below:

In column 1, line 2, insert -- 1. Related Applications -- .

In column 1, line 8, delete "1. Related Applications" .

In column 6, line 24, delete "the angle a" and insert -- the angle $\alpha$ -- .

Signed and Sealed this

Ninth Day of January, 2001

*Attest:*

Q. TODD DICKINSON

*Attesting Officer*

*Commissioner of Patents and Trademarks*